US005148695A

United States Patent [19]

Ellis

[11] Patent Number: 5,148,695

[45] Date of Patent: Sep. 22, 1992

[54] ADJUSTABLE PIPE AND TUBING BENDER

[76] Inventor: Harry S. Ellis, 62359 Verde Dr., Montrose, Colo. 81401

[21] Appl. No.: 796,543

[22] Filed: Nov. 21, 1991

[51] Int. Cl.[5] ..... B21D 7/04

[52] U.S. Cl. ..... 72/158; 72/149; 72/388

[58] Field of Search ..... 72/149, 157, 158, 159, 72/156, 155, 154, 153, 369, 217, 387, 388

[56] References Cited

U.S. PATENT DOCUMENTS

| | | | |
|---|---|---|---|
| 2,171,907 | 9/1939 | Beehler et al. | 72/154 |
| 2,620,848 | 12/1952 | Paoli | 72/217 |
| 2,754,880 | 7/1956 | Kuehlman et al. | 72/158 |
| 2,762,416 | 9/1956 | Middleton | 72/388 |
| 3,861,186 | 1/1975 | Wigner Jr. | 72/217 |
| 4,355,528 | 10/1982 | Rothenberger | 72/388 |
| 4,986,104 | 1/1991 | Caporusso et al. | 72/149 |

FOREIGN PATENT DOCUMENTS

| | | | |
|---|---|---|---|
| 0627885 | 10/1978 | U.S.S.R. | 72/149 |

*Primary Examiner*—Lowell A. Larson
*Assistant Examiner*—Michael J. McKeon
*Attorney, Agent, or Firm*—Donald W. Erickson

[57] ABSTRACT

A bending apparatus for metal pipe and tubing which includes an upright spindle assembly; a lower section mounted on the spindle assembly for rotational movement around the spindle, the lower section can be selectively moved around and engaged with the spindle assembly; an upper section which is rotatably mounted on the spindle assembly and removably connected to the lower section, the upper section includes a removable shoe bender; and a radius die positioned at the top of the spindle assembly and in pipe or tube engaging alignment with the shoe bender. The bending apparatus can be disassembled, and moved to a different work site, and reassembled by one person. The bending apparatus can bend pipe or tubing of one-half inch to two inch diameter and larger.

3 Claims, 11 Drawing Sheets

ADJUSTABLE PIPE AND TUBING BENDER

BACKGROUND OF THE INVENTION

This invention relates to a pipe and tubing bender which is very versatile and accurate in obtaining the desired angle of bend. In construction such as large buildings, ships, submarines, utility plants, and the like, the bending of pipe and tubing to be used as a conduit for fluids or for protecting wires or cables can be very exacting and demanding. There exists a need for a bender that provides accuracy in obtaining the desired angle of bend and, at the same time, is versatile in the sense of adjusting easily to changing the angle of bend desired. The bender needs also to be easily adjustable to accommodate various diameters of pipe or tubing. In addition, the bender needs to be versatile in the sense of easy relocation from one work site to another. The pipe and tubing bender of the present invention fulfills the foregoing needs.

SUMMARY OF THE INVENTION

The present invention is directed at a novel metal pipe and tubing bending apparatus (bender). The bender is both very accurate and versatile. Basically, it comprises an upright spindle assembly, a lower section which is mounted on and rotatably and selectively adjustable around said spindle assembly and an upper section which is rotatably mounted on said spindle assembly and removably connected to said lower section, said upper section being joined to a hydraulic pressure source for providing the pressure needed to bend the pipe or tubing.

DETAILED DESCRIPTION OF THE INVENTION

Figure 1:
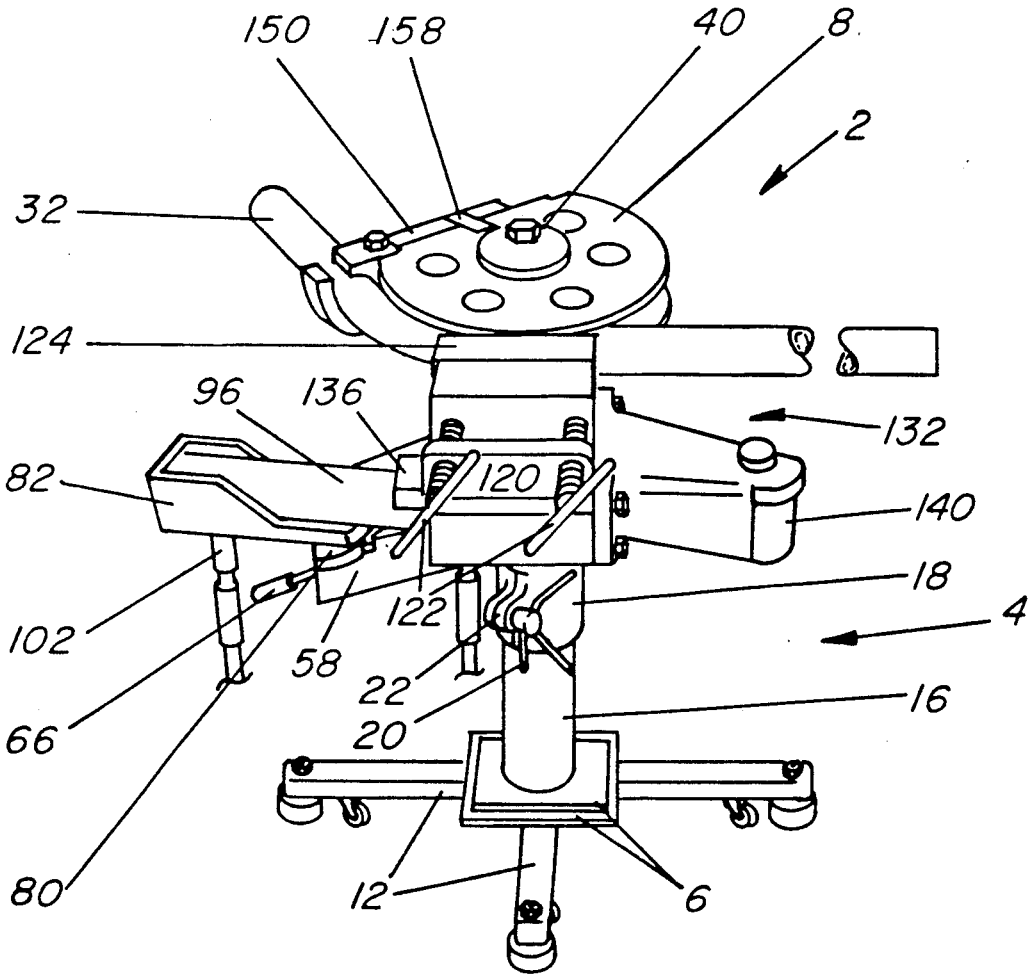
FIG. 1 is an upper perspective view of a pipe and tubing bender in accordance with the present invention.

With reference to FIG. 1, there is shown a perspective view of a pipe and tubing bender 2 in accordance with the present invention. Each of the components making up the bender 2 are shown in subsequent figures and are described hereinafter in detail beginning with spindle assembly 4 and base 6 and proceeding upward to radius die 8.

Figure 2:
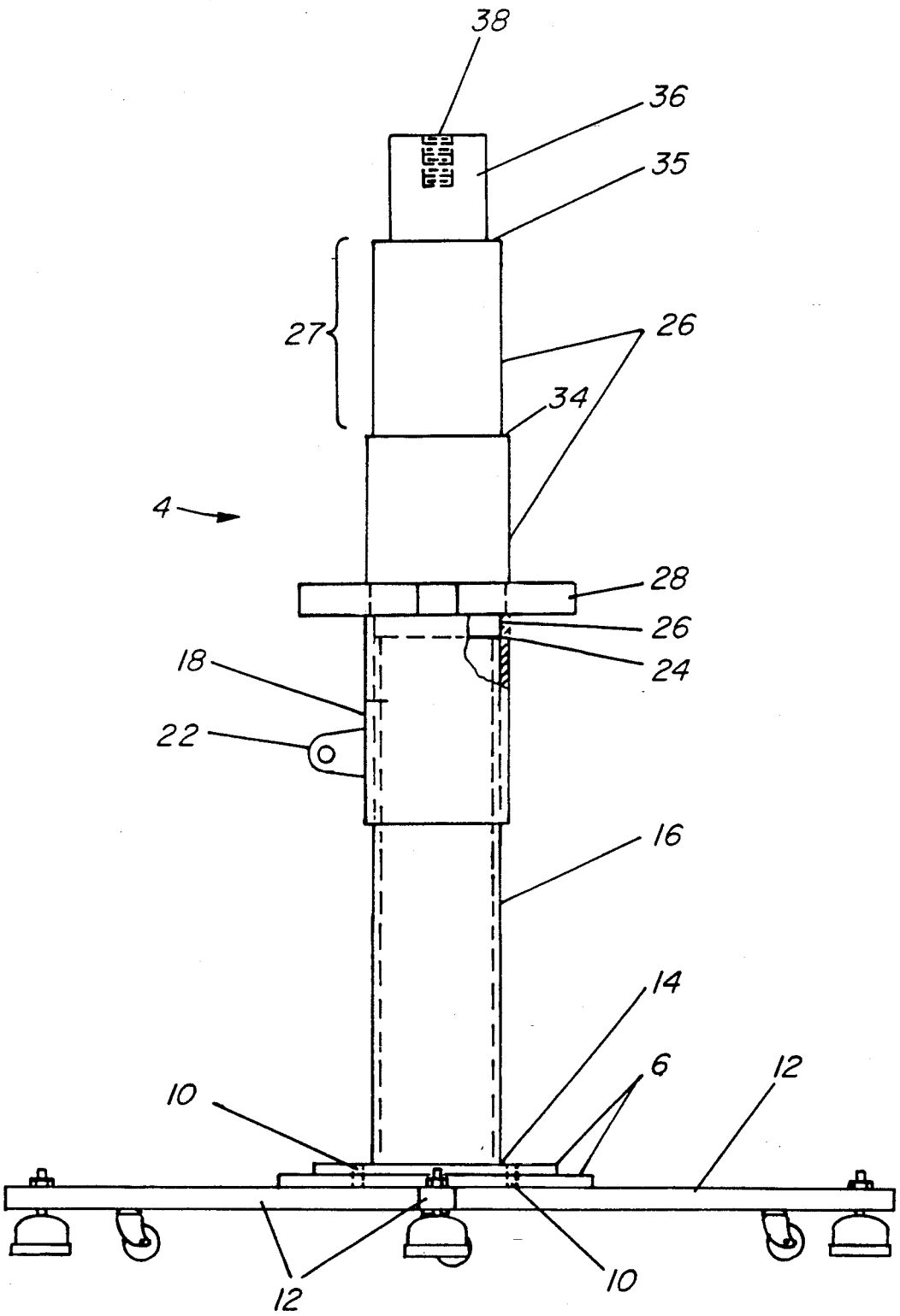
FIG. 2 is an enlarged side elevational view of the spindle assembly and a flange having a plurality of notches used in the bender of FIG. 1.
Figure 3:
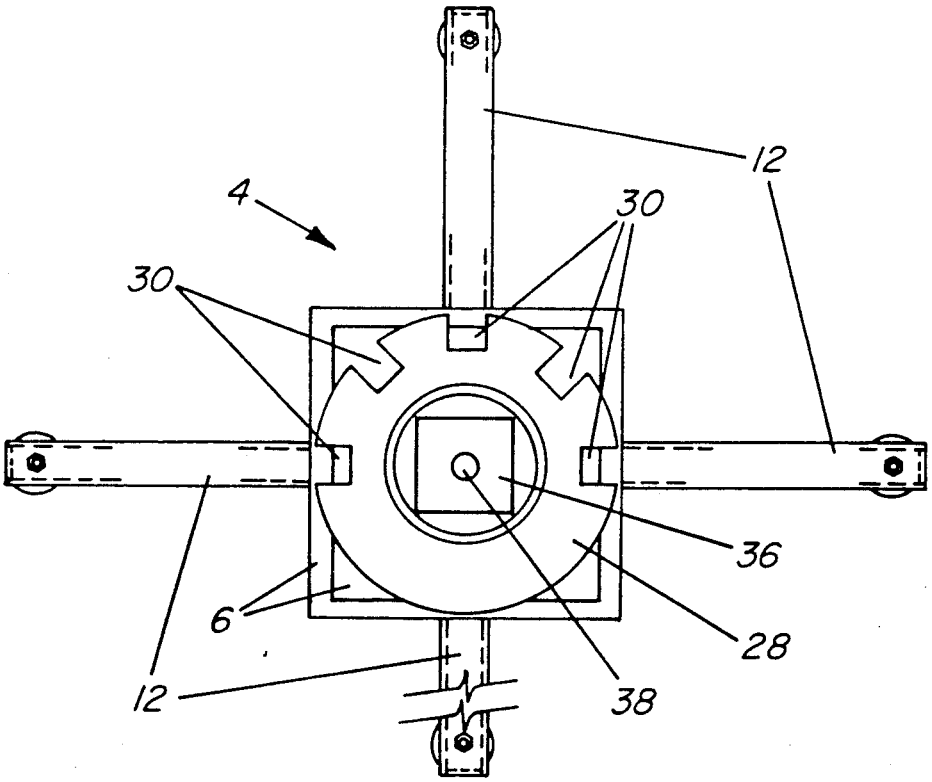
FIG. 3 is a top plan view of the spindle assembly and notched flange of FIG. 2.

The spindle assembly 4 and spindle base 6 are shown in side elevation in FIG. 2 and top plan view in FIG. 3. The base plates are each 0.375" hot rolled steel, bottom plate 10" square and top plate 7.750" square. Both plates are drilled (13/32"), 4 holes 10 to form a 6" bolt circle. Legs 12 are welded to the base 6. Base pipe member 16 of the spindle assembly 4 is welded at 14 to the top surface of base 6. The bottom base pipe 16 of the spindle has outside diameter (OD) of 4.125" and wall thickness of 0.250" and overall height of 19.125". The upper end of pipe 16 is turned to reduce the OD to 4.038" for a length of 7.250". Thus, a small shoulder is formed on pipe 16 at 11.875" from the bottom end of the pipe. The top end of member 16 is blocked off with 0.250 steel plate which is machined smooth at right angles to the side wall. Over the reduced upper end of pipe 16 is fitted adjustment sleeve member 18 which has a length of 6.875", bore of 4.040" and wall thickness of 0.250". It rests on the shoulder of and is rotatable around pipe 16 to any desired position using handle 20 which is threaded into split collar 22 of member 18. The upper end of member 18 is connected as by welding at 24 to the bottom of shaft 26. Near the bottom of shaft 26 and welded thereto is bottom flange 28 having a plurality of notches 30 spaced equidistant around one half its periphery. The flange 28 is 1" thick, outside diameter of 8.750" with centered circular cut-out having a diameter of 4.438" through which the reduced bottom end (OD 4.437") of shaft 26 extends 0.625" below the bottom surface of the flange at which point the two pieces (28 and 26) are welded together. The notches are 1.252" wide and 1.020" deep and spaced so as to obtain an incremental change of angle in bending of pipe or tubing 32 of 45 degrees. The spindle shaft 26 has a height or length of 15.895" and an OD of 4.500". However, the bottom end is turned for 1.625" to a reduced OD of 4.437" and the intermediate section 27 is turned for 6.260". to a reduced OD of 4.180" to form a shoulder 34. The top or upper end 36 of shaft 26 is square ended (3.125"). It has a height of 3.130" as measured from the top surface of section 27. Square end 36 is tapped (1") to form a threaded bore 38 (2" deep) which receives threaded cap 40 which, in turn, holds radius die 8 securely in place.

Figure 5:
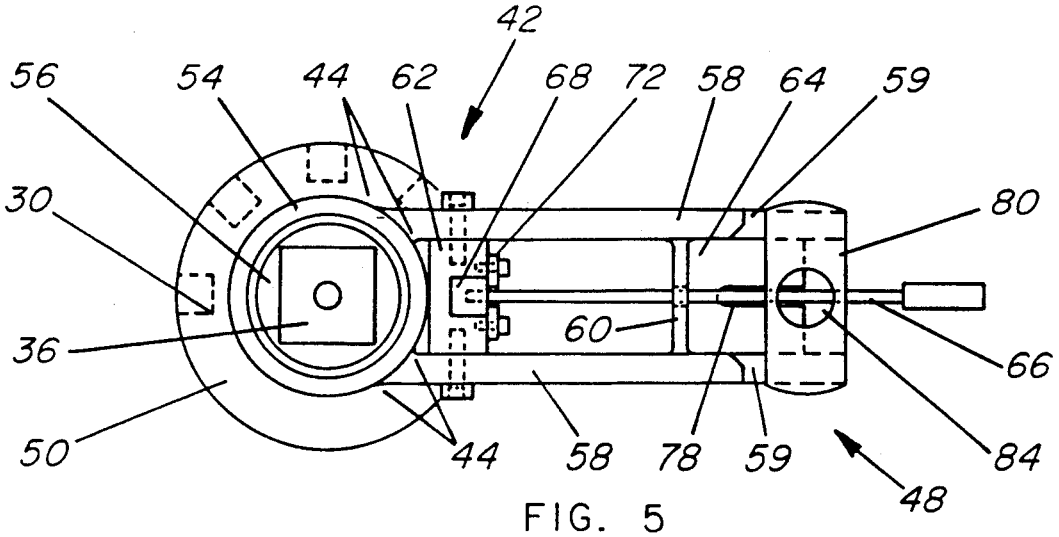
FIG. 5 is a top plan view of the ram arm assembly and spindle of FIG. 4.
Figure 4:
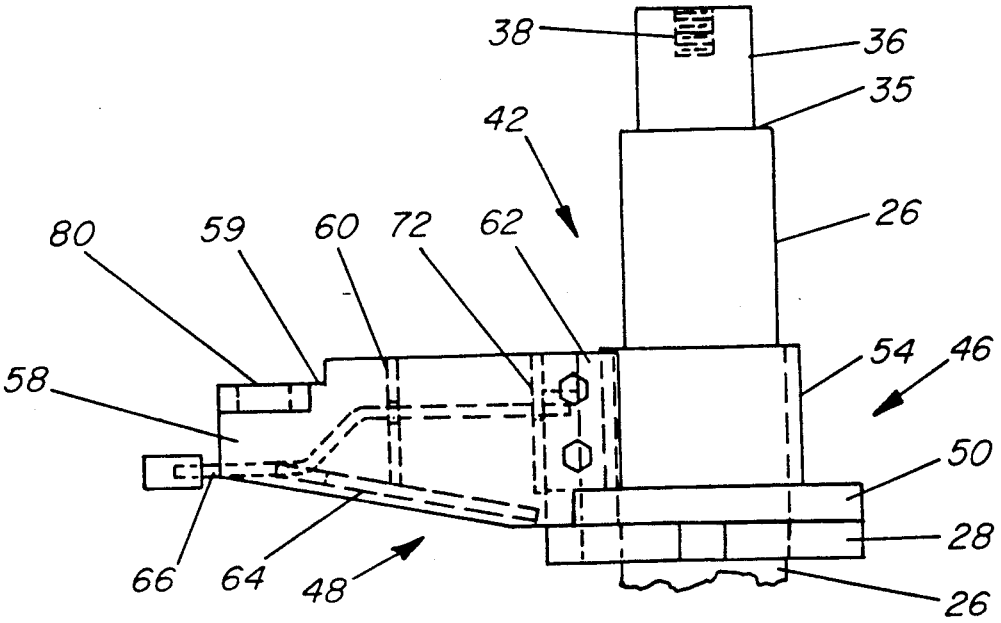
FIG. 4 is a side elevational partial view of the ram arm assembly mounted on the spindle of FIG. 2.
Figure 6:
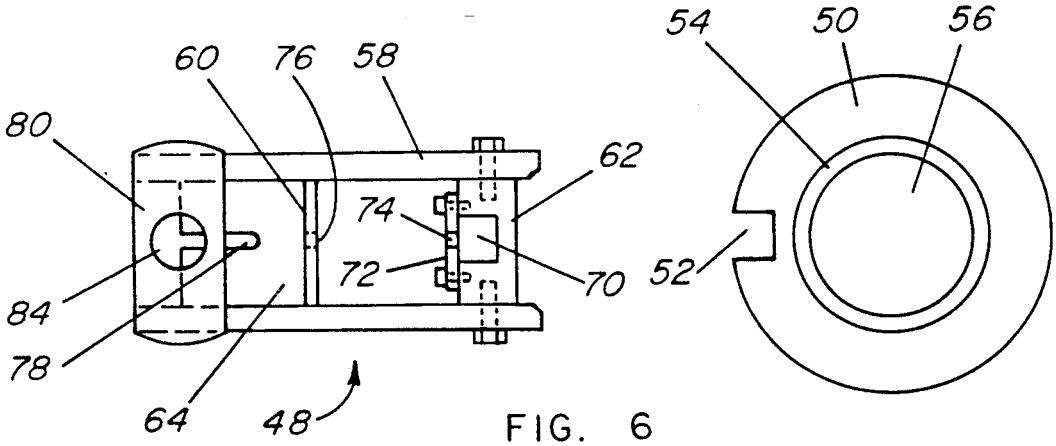
FIG. 6 is a top plan view of the ram arm frame and single notched flange of the ram arm assembly of FIGS. 4 and 5 prior to welding the frame and flange together.
Figure 7:
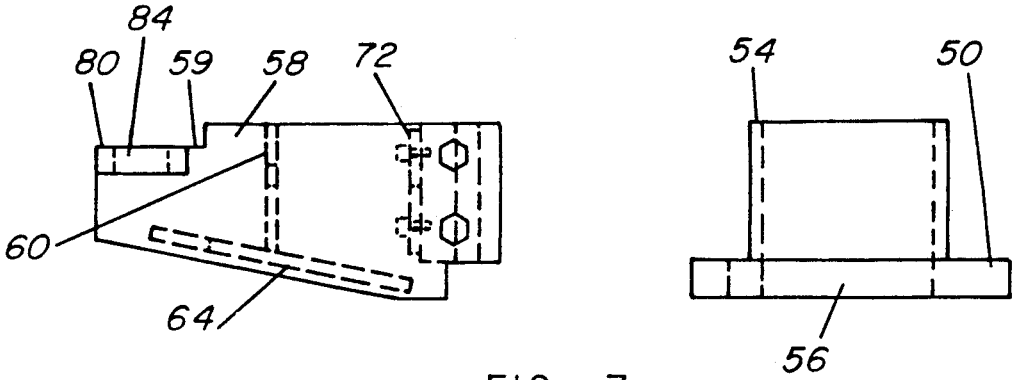
FIG. 7 is a side elevational view of the frame and flange of FIG. 6.
Figure 8:
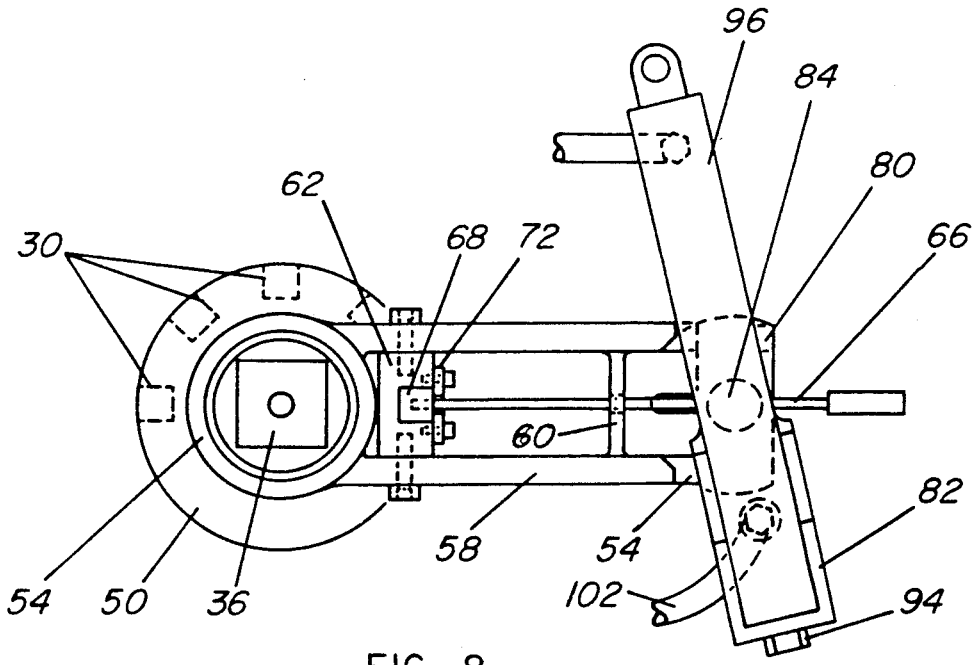
FIG. 8 is a top plan view showing the pressure cylinder and ram saddle mounted on the ram arm assembly of FIG. 5.
Figure 9:
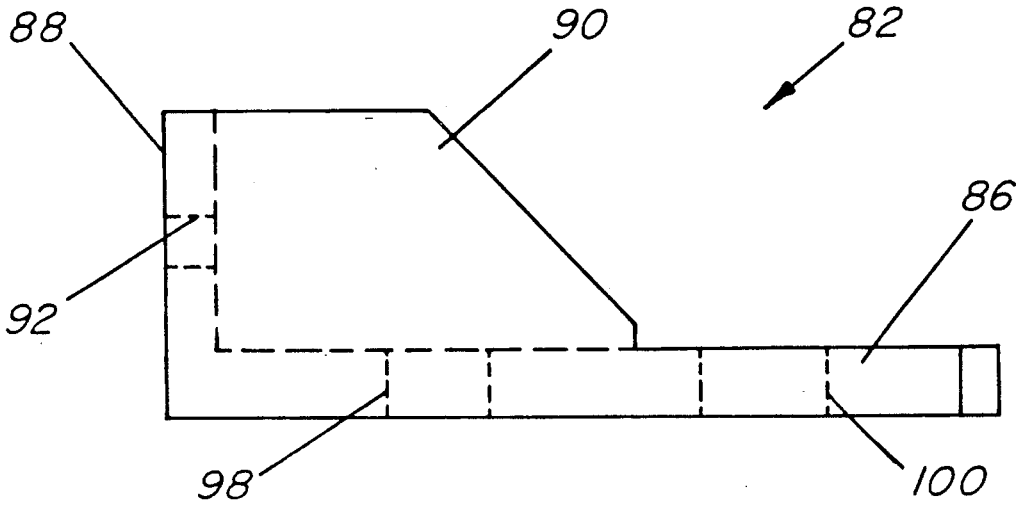
FIG. 9 is an enlarged side elevational view of the ram saddle only which is used in FIG. 8.

Next is the provision of ram arm assembly 42 which is rotatable around shaft 26 and releaseably engages with any pre-selected notch 30 of flange 28. As shown in FIGS. 4 and 5, the ram arm is firmly engaged in the first notch of flange 28, which, in operation, will result in a pipe or tubing bend of up to about 50 degrees. The ram arm assembly 42 is basically two subassemblies 46 and 48, see FIGS. 6 and 7, which are welded together at 44. Subassembly 46 includes a flange 50 having single notch 52 therein and a sleeve 54 concentric with the circular cut-out or bore 56, best seen in FIGS. 6 and 7. The flange 50 has a thickness of 1", OD of 8.750" and the notch 52 is 1.252" wide and 1.020" deep. The bore 56 cut into the flange has a diameter 4.503" and similarly the ID of sleeve 54 is 4.503". The sleeve is welded to flange 50. The flange and sleeve together have a finished height of 4.715" which places the top of sleeve 54, 0.015", above shoulder 34 (FIG. 2). Subassembly 48 is welded to sleeve 54 and flange 50 so that the inner end thereof is centered on notch 52. Subassembly 48 includes two parallel frame members 58 (length 11.438", spaced apart ID of 3.500") and cross members 60, 62 and 64 connected to the inner walls of frame members 58. Cross members 60, 62 and 64 are adapted to cooperatively receive and guide lock pin lever 66. Lock pin block 68 has a 0.375" threaded bore for connection thereof to lever 66. The block is 1.000" deep, 1.250" wide and 4.750" height. It slidably moves up and down in notch 52 for disengagement and engagement, respectively, with any of notches 30 of stationary flange 28. Cross member 62, which also may be referred to as a pin guide block, has a guide channel 70 centered therein, as best seen in FIGS. 5 and 6, measuring 1.020" deep, 1.252" wide and 3.715" height to cooperatively receive and guide the up and down movement of block member 68. Attached to the face of guide block 62, as by bolting, is guide plate 72 which has a U-shaped channel 74 (1.438" deep and 0.406" wide) in the top section thereof, to positively guide the up and down movement of lever 66. The generally U-shaped channel 74 is centered on guide channel 70 and notch 52. Cross member 60 (3.500" wide, 3.375" height) is provided with an oval hole 76 (0.531" wide), centered and about 1.375" from its top edge to allow passage of and to provide a fulcrum for lever 66. Bottom cross member 64 (3.500" wide, 7.500" long), attached near the bottom edge of frame members 58, best seen in FIG. 6, has a U-shaped channel 78 (2.000" deep, 0.531" wide) cut into its outer edge to allow for movement of and provide guidance for lever 66. By pressing lever 66 downward, the ram arm assembly is free to rotate to align lock pin block 68 in any of the notches 30 and then upward movement of the lever will engage the lock pin block in the notch selected. The ram arm assembly is thus stationary or fixed and cannot be rotated until lever 66 is pressed downward. At the outer end of frame members 58 is positioned a ram mount 80 which is designed to securely hold ram saddle 82 (FIGS. 8 and 9) while at the same time allowing the ram saddle to rotate in bore 84 of the ram mount. Frame members 58 are notched, as best seen in FIG. 7, 2.500" deep and 1,500" from the top edge thereof, and the ram mount welded thereto. The ram mount is 0.750" J alloy steel or A.R. 360 steel as is frame members 58. The frame members 58 are further notched at 59 (0.500" deep) 0.750" from the top edge to allow for adequate rotational movement of ram saddle 82. The bore 84 (diameter 1.500") is centered at midpoint of the length and width of the ram mount 80.

Figure 9A:
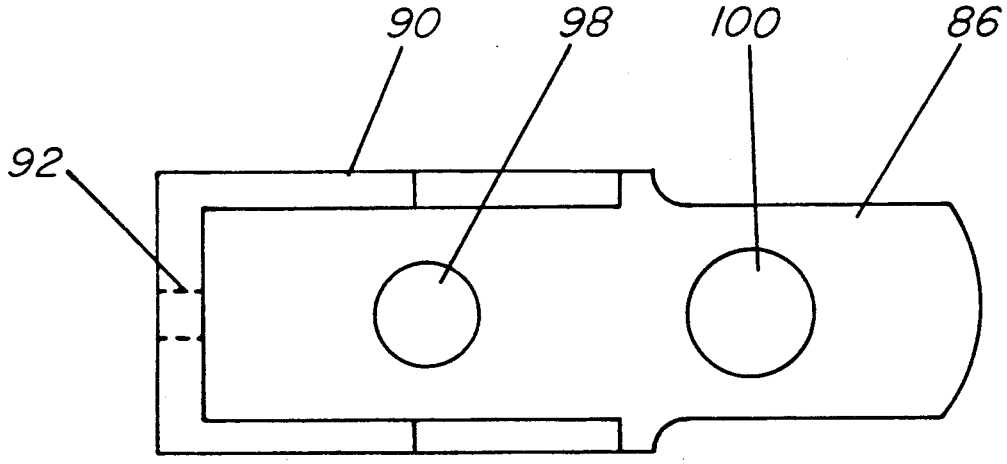
FIG. 9A is a top plan view of the ram saddle of FIG. 9.

The ram saddle 82 has a base plate 86 made of 0.750" J alloy steel or A.R. 360 steel, measuring 9.4375" length by 3.500" width. The back plate 88 (2.750" by 3.500") and tapered side plates 90 (top edge 2.375", bottom edge 4.875") are 0.500" and 0.375" hot rolled steel, respectively. The back plate is drilled at the center thereof to provide a bore 92 (0.5625") through which bolt 94 passes to threadedly engage and hold pressure cylinder 96 in the saddle. In the base plate, there is drilled bores 98 (1,3125" diameter) and 100 (1.500"). Bore 100, which matches up with bore 84, is centered 6.437" from the inside wall of back plate 88. Bore 98 is centered 3.750" from the center of bore 100. Bore 98 is adapted to receive pressure hose 102 which is connected to a conventional compressor (not shown) and pressure cylinder 96. As best seen in FIG. 9A, the inner end of the base plate is tapered inwardly (tongue shape) 0.375" on each side for a length of about 3.001" and the corners rounded. This shape in cooperation with the top notch 59 provides space for rotational movement of the ram saddle 82.

Figure 10:
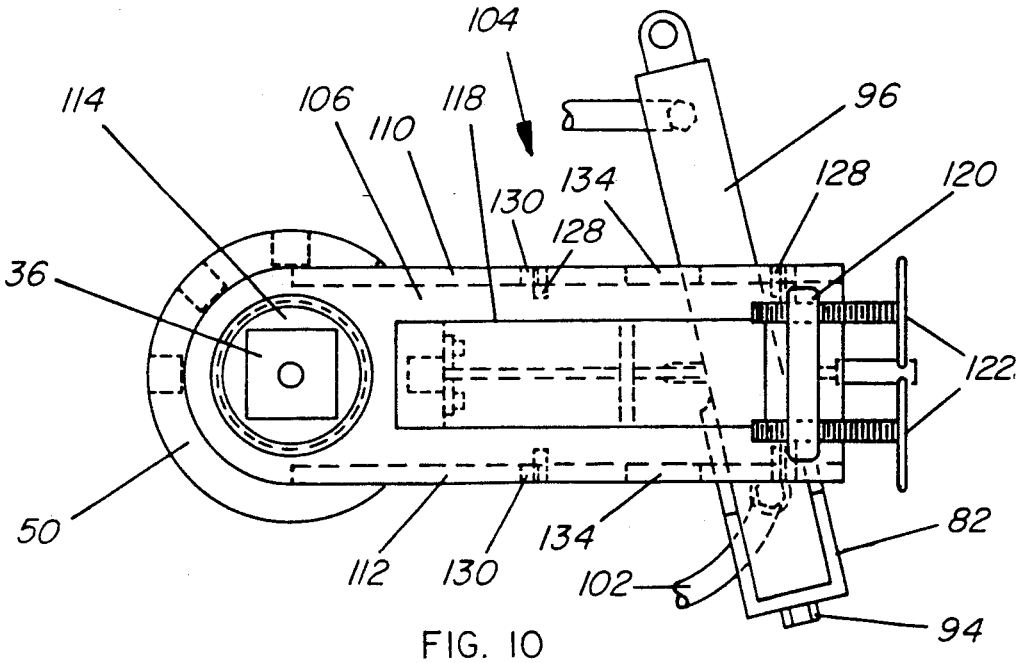
FIG. 10 is a top plan view of the ram head and bending shoe supporting frame mounted on the spindle of FIG. 8.
Figure 11:
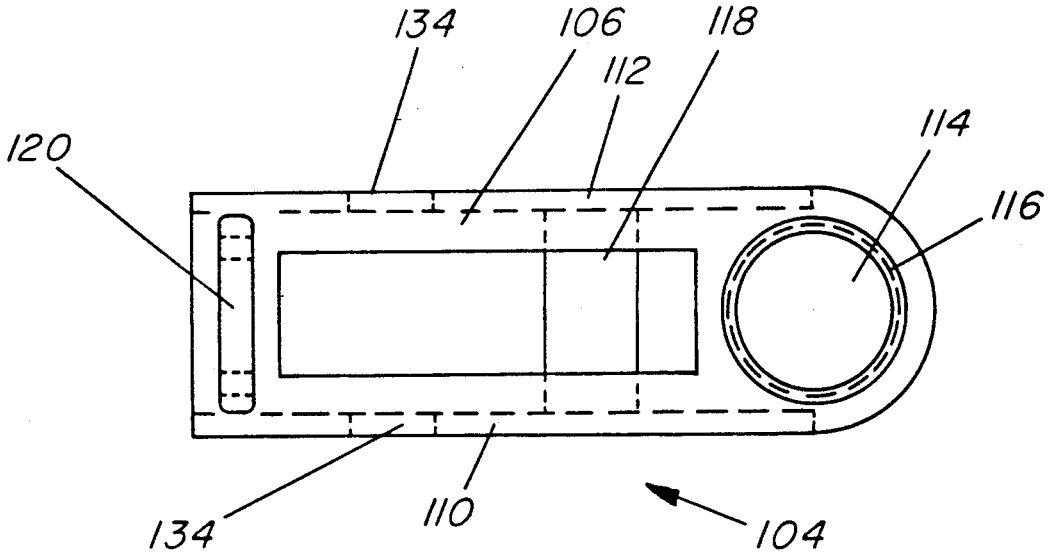
FIG. 11 is a top plan view of the supporting frame only of FIG. 10.
Figure 12:
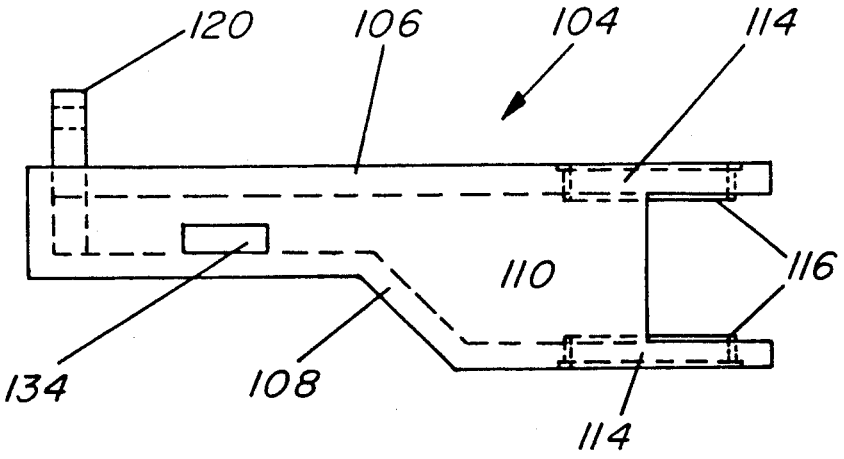
FIG. 12 is a side elevational view of the supporting frame of FIG. 11.
Figure 14:
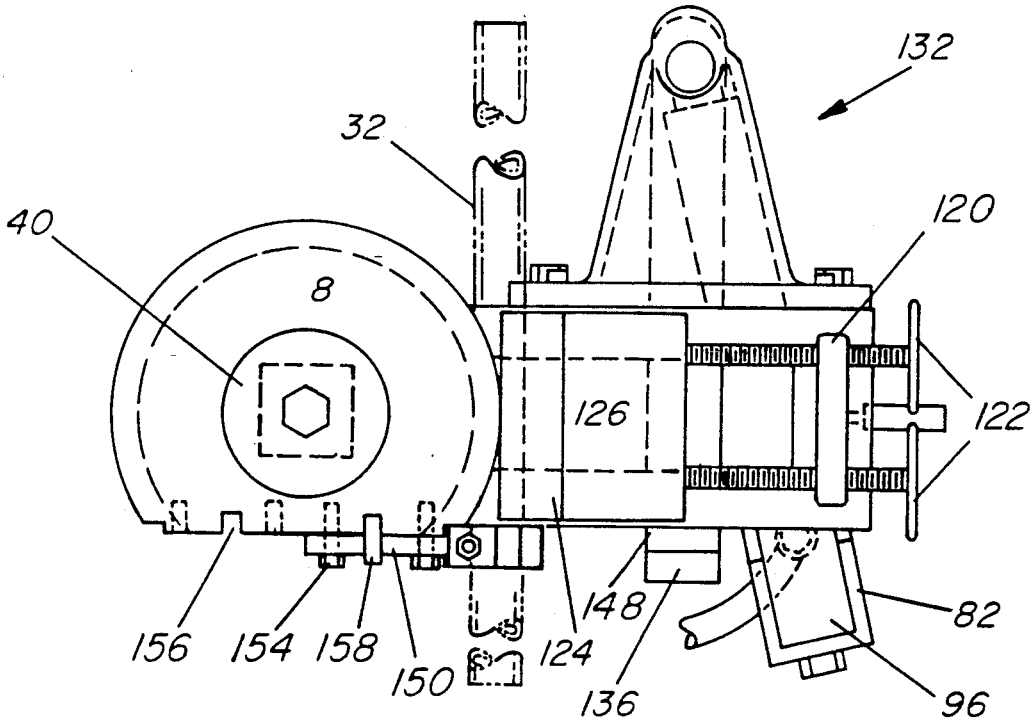
FIG. 14 is a top plan view, like FIG. 13, with the radius die in place on the square head of the spindle and bending shoe and shim in place in readiness to bend a pipe.
Figure 13:
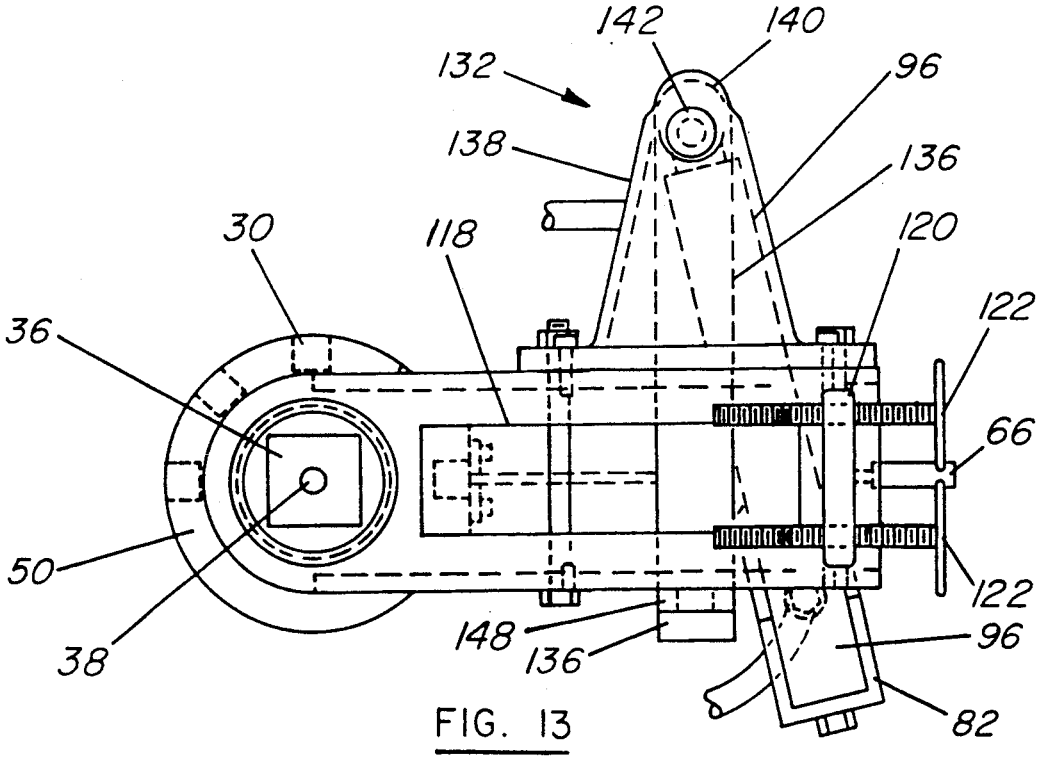
FIG. 13 is a top plan view showing the ram head attached to the supporting frame of FIG. 10 and to the pressure cylinder.

Next, there is provided a ram head and bending shoe supporting frame 104, best seen in FIGS. 10–12, which is mounted on spindle 4 (at section 27 thereof, see FIG. 2) for rotation therearound. Supporting frame 104 has OD of 7.000" by 18.750" with a height of 6.225" at its inner end (spindle engaging end) and height of 3.250" at its outer end (upper plate 106 and lower plate 108). The height at the inner end is very important so that shoulder 35 of the spindle is 0.020" above the top surface of plate 106 when frame 104 is mounted on the spindle. The upper and bottom plates are 0.750" J alloy steel and side plates 110 and 112, spaced between plates 106 and 108 and welded thereto, are 0.625" hot rolled steel. As best seen in FIGS. 11 and 12, frame 104 is rounded at its inner end and provided with bores 114 in the upper and lower plates. Each bore includes a bronze liner 116 which has an ID of 4.182" and height of 1.000". The bore is centered, as shown, 3.500" from the inner end of plates 106 and 108. The top plate has a rectangular cut-out 118 (3.500" by 10.000"), the inner edge of which is 3.107" from the center of bore 114 and centered thereon. Near the outer edge of the frame and parallel thereto is a threaded block 120 which extends through a cut-out in the upper plate and rests on the lower plate. It is welded to both plates. T-bolts 122 are threaded into the block and serve to firmly hold bending shoe 124 and shim 126 against pipe 32, see FIG. 14, for example. The outside wall of block 120 is spaced 0.625" from the outer edge of plates 106 and 108. The T-shaped threaded block 120 is 1.000" 4140 steel and has height of 5.000", top width 6.500" (extends 2.500" above plate 106) and bottom half (2.500") has a width of 5.750". The tapped threaded holes of block 120 have a radius of 0.625" and are centered 1.645" above plate 106 near the upper curved corners of the block. Plate 106 and 108 are tapped (0.500", 0.750" deep) at 128 and side plates 110 and 112 are drilled (0.5313") at 130 for the mounting of ram head assembly 132. A rectangularly shaped cut-out 134 is made straight through side plates 110 and 112 to receive draw bar 136. The cut-outs 134 have a width of 2.631", height 0.771" and are centered 5.500" from outer end of side plates 110 and 112.

Next, the ram head assembly 132 is joined to support frame 104 and pressure cylinder 96, best shown in FIGS. 13, 16, 16A, and 17. The assembly 132 includes a generally V-shaped housing 138 (open at its bottom side), draw bar 136 and ram connection block 140 which is welded to the narrow end of housing 138. A removable pin 142 extends through the draw plate 136, connection block 140 and eye bolt 144 connected to pressure cylinder 96. At the other end of the ram head assembly, the draw plate 136 has notches 146 which extend through side plate 112 at 134 and receive a removable key 148 which retains or locks the draw plate firmly in place. The key lock 148 is made of hardened steel.

Figure 18:
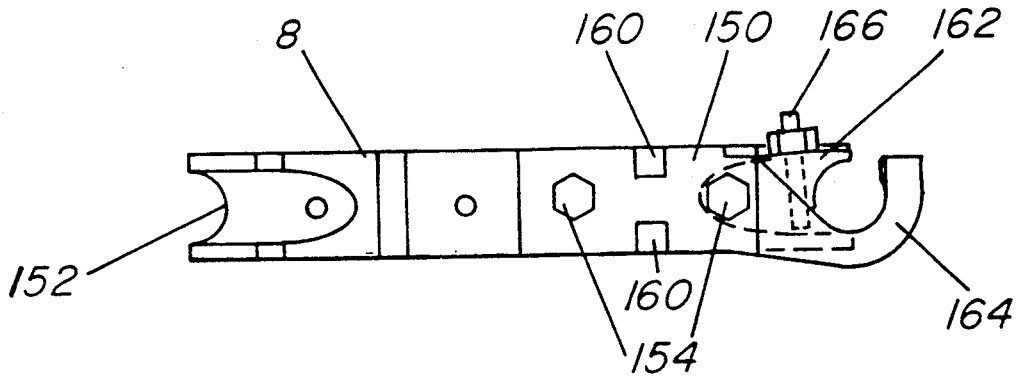
FIG. 18 is a side elevational view of the radius die and the pipe holder shown in FIGS. 14 and 15.
Figure 19:
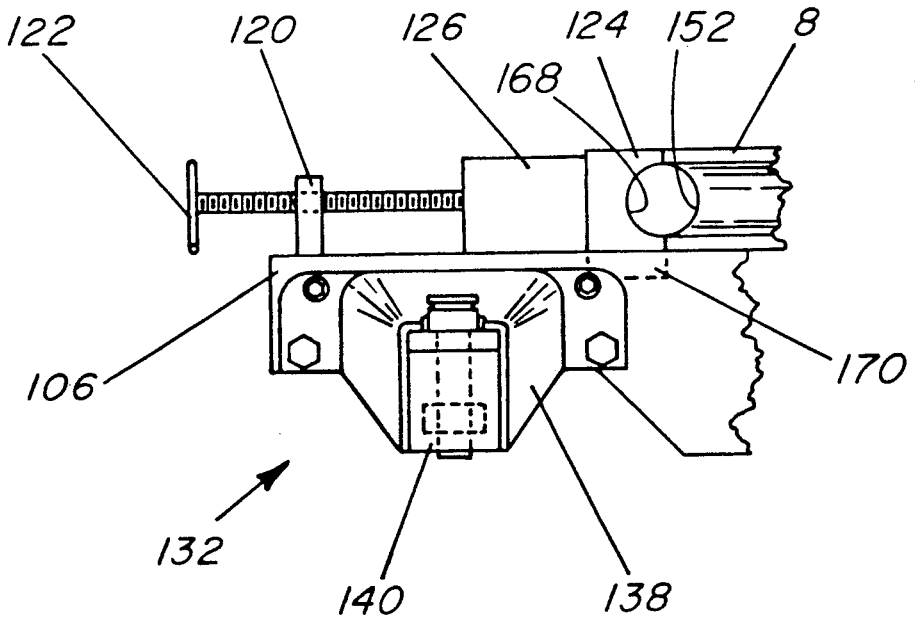
FIG. 19 is an enlarged, partial end view of the bending shoe shown in FIGS. 14 and 15.

Referring to FIG. 18, there is shown, enlarged, a side elevational view of the radius die 8 and pipe holder or latch 150 bolted to the die. With reference to FIGS. 2 and 13–15, the radius die has a substantially square center which slidably mates with the square upper end 36 of shaft 26 and permits the bottom surface of the die to rest on shoulder 35. This arrangement insures that the die will not rotate. To insure that the die does not move vertically, a threaded cap 40 is screwed into bore 38 of member 36. A number of interchangeable radius dies, latches and bending shoes can be made in order for the bender to accommodate pipe or tubing from one-half inch to two inch standard or larger. In the embodiment shown, using a die, latch and bending shoe for bending two inch standard pipe, the die 8 has a radius of 8.938 inches and a thickness of 3.250 inches. The perimeter groove 152 of the die has a diameter of 2.375 inches. The square center measures 3.127 inches. The die can be made of cast iron. The flat vertical surface of the die is tapped (½") at 4 places to receive bolts 154 for holding the latch to the die. Also, the flat vertical surface has a notch 156 at 2 places to receive lock key 158 for holding the latch to the die. Also, the lock key 158 takes the pressure when bending pipe instead of bolts 154. By having two sets of taps and notches 156, latch 150 can be secured to either side of the flat vertical surface of the die. This provides the operator a choice of work positions in view of the maneuverability of ram arm assembly 42 around shaft 26. Also, it provides convenience of choice for a right or left handed person in operation of the machine. The latch 150 is drilled at two places to receive bolts 154 and notched twice at 160 to receive key lock 158 (see FIG. 18, key lock not in place). At the outer end of the latch is provided a pipe engaging jaw formed by members 162 and 164. The radius of the jaw is 1.188 inches. Jaw forming member 162 is threaded to and a part of latch 150 using stud 66 as best seen in FIG. 18. Members 162, 164 and 166 are hardened steel. The bending shoe 124 has a groove 168 therein of 2.375 inches diameter to match the groove 152 of the radius die. The shoe has a length of 7 inches, width of 2.5 inches and height of 3.275 inches. At the base thereof is a centered shoulder 170 measuring 3.5 inches by 0.75 inches by 2.5 inches which seats in the rectangular cut-out 118 of frame 104, thereby preventing any lateral movement of the shoe (see FIGS. 13, 14, and 19). The shoe is of hardened steel. The shim 126, positioned between T-bolts 122 and the shoe 124, is made of mild steel. Based on the foregoing specific description applicable for a die, latch and shoe for bending 2 inch material, one of ordinary skill in the art can easily make a die, latch and shoe for bending material less than or greater than 2 inches.

Figure 15:
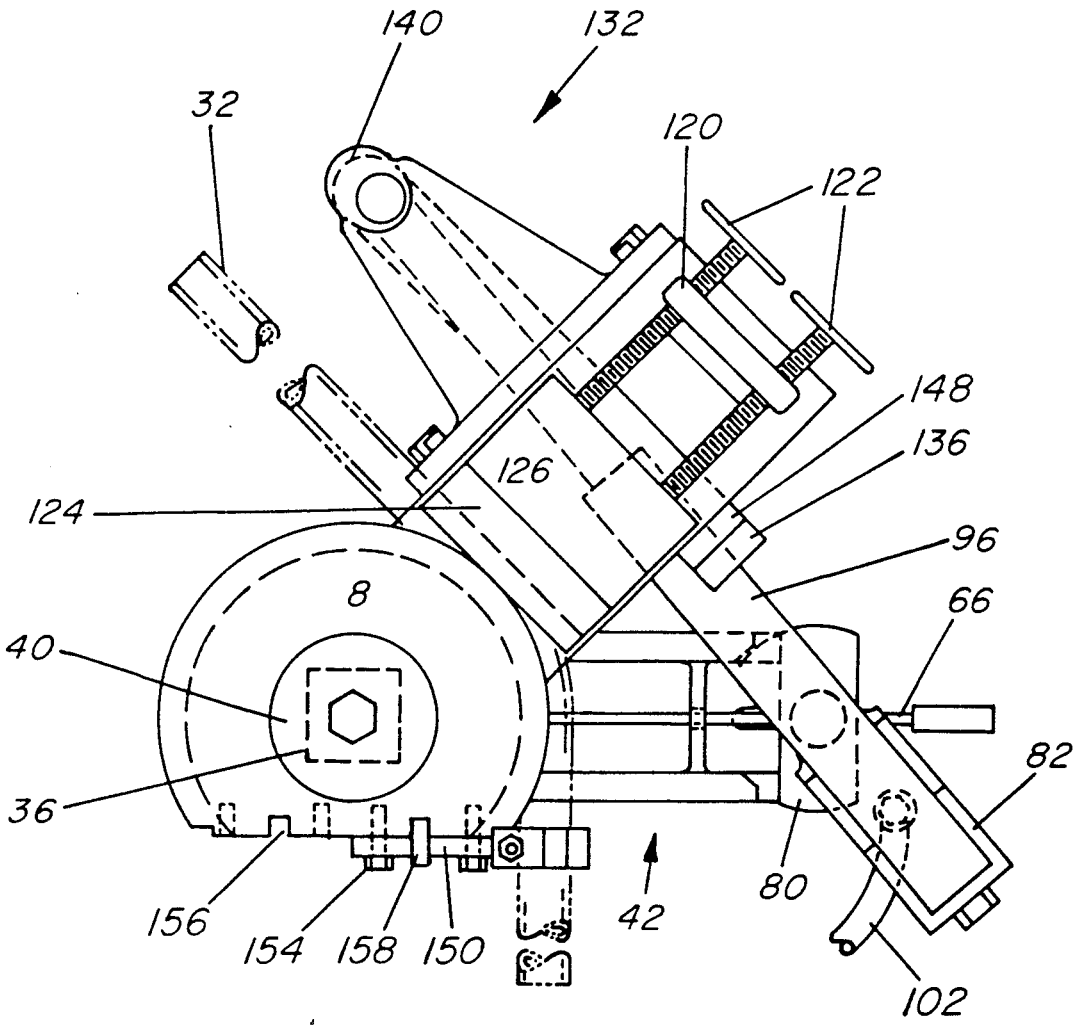
FIG. 15 is a top plan view, as in FIG. 14, showing the cylinder extended and bending of a pipe, the ram arm being in the first notch position.
Figure 16:
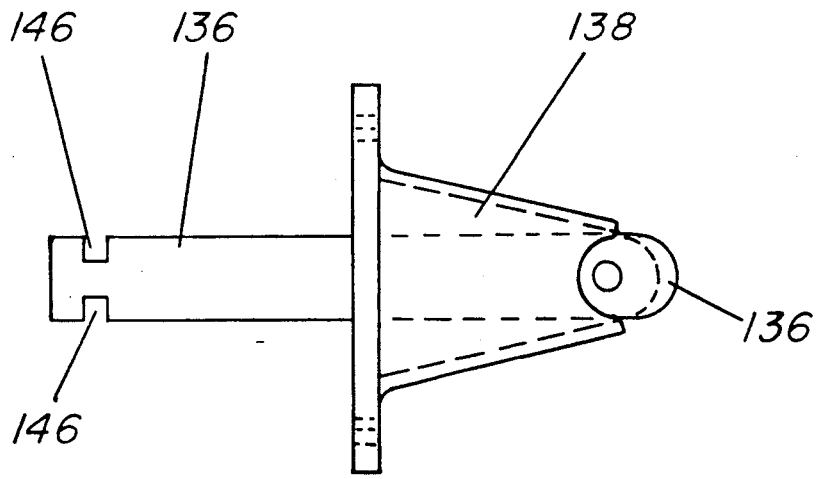
FIG. 16 is a top plan view of the ram head and draw bar of FIG. 13.
Figure 16A:
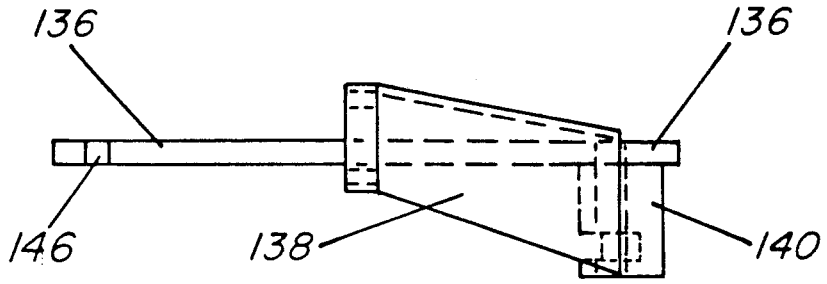
FIG. 16A is a side elevational view of the ram head, draw bar and connection block of FIG. 13.
Figure 17:
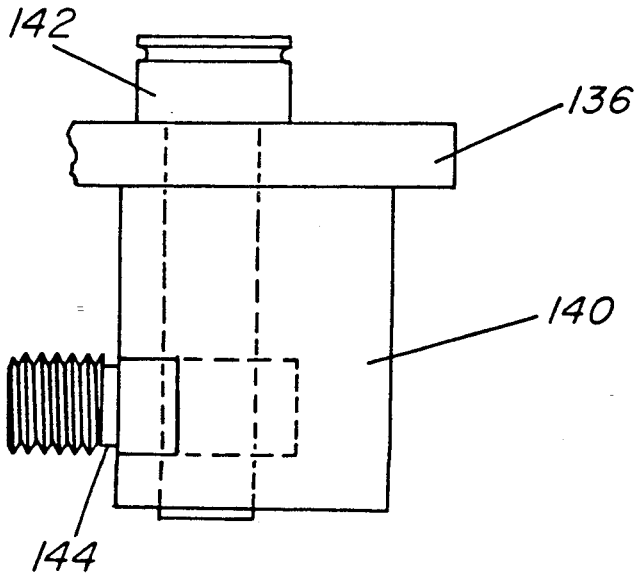
FIG. 17 is a partial side elevation view, enlarged, of the ram cylinder connection block with retention pin in place of the ram head of FIG. 16A.

With reference to FIG. 15, there is shown the bending of a pipe with ram arm assembly 42 engaged and held in place in the first notch 30 (right side of plate 50), see FIGS. 4 and 10 also. Hydraulic pressure is supplied to pressure cylinder 96 via hose 102 from a conventional compressor (not shown), thereby causing ram head supporting frame 104 and ram head assembly 132 to rotate around shaft 26 up to a maximum of about 50 degrees. By putting the ram arm assembly 42 in the second notch 30, a bend in the pipe of up to 90 degrees or slightly more can be obtained. Each increased setting of the ram arm assembly in the notches 30 increases the bend about 45 degrees. An index, not shown, can be provided, for example, on the top surface of radius die 8 to indicate to the operator the degrees of bend in the pipe as ram head assembly 132 and bending shoe 124 rotate so that the operator can achieve accurately the amount of bend desired.

The ram head assembly, in the embodiment shown and described, is designed for pressures of up to about 10,000 psi. In the case of the bending of a two inch standard pipe, a pressure of only about 3,500 psi is needed which leaves a very considerable margin. The ram head assembly, particularly housing 138, and cutouts 134 of the ram arm assembly, act as stabilizers for the draw bar 136. During the bending operation, it puts the pressure of the draw bar on the back side where key lock 148 is positioned. Also, the housing 138 prevents the draw bar from lifting up during the bending operation.

In addition to the precision bending that can be done with the bender of the present invention and the ease with which various sizes of pipe and tubing can be accommodated, a very important additional advantage is that the bender can be easily dismantled by one person in only a few minutes, transported to a new site, and reassembled by one person in only a few minutes. No special tools, fork lifts, or the like are needed. This is because the bender can be dismantled into a few parts, each part being easily handled by a single person. In brief, to dismantle the bender, a person need only take the following steps: 1. remove radius die 8 and latch 150 as one piece; 2. remove the top section, as one piece, which includes the interconnected pressure cylinder 96, ram saddle 82, frame 104, ram head assembly 132 and, optionally, bending shoe 124; and 3. remove the lower section, as one piece, which is made up of ram arm assembly 42. This dismantling leaves only spindle 4 (FIG. 2) intact. Spindle 4, if desired, can be dismantled into 2 pieces by relieving the pressure on sleeve 18 and lifting it and shaft 26, as one piece, off of pipe 16. Alternatively, the lower section (ram arm assembly 42) and shaft 26 (along with sleeve 18) can be removed as one piece. To reassemble, the person simply reverses the foregoing sequence. Each piece, as described in the foregoing steps, is easily managed by one person.

Another advantage of the bender of the present invention is that the operator can leave sleeve 22 of the spindle assembly untightened and thereby permitting simultaneous rotation of the lower and upper sections of the bender. This enables the operator to bend even long lengths of pipe in a small or cramped space. For example, in a space only eight feet wide, an operator can put a 90 degree bend, midpoint, in a twenty foot long pipe because of the foregoing rotational maneuverability of the bender.

What is claimed is:

1. A pipe and tubing bender which comprises:

an upright, free standing, spindle assembly having a vertical axis, said spindle assembly comprising a lower part and an upper part, said upper part, at its lower end, having sleeve means which releasably fits over said lower part and is concentric therewith, said sleeve means being rotatable around said lower part;

a lower section which is removably mounted on said spindle assembly and which is rotatably movable and selectively adjustable around the vertical axis of the spindle assembly, said lower section including means for releasably engaging said spindle assembly;

an upper section which is removably mounted on said spindle assembly, said upper section being rotatably movable around the vertical axis of the spindle assembly, said upper section being removably and pivotally connected to said lower section, said upper section having shoe bender means thereon which is adjustable for engaging a pipe or tube for bending, said upper section having means to apply pressure to and cause said shoe bender means to move and bend the pipe or tube;

said upper part of the spindle assembly having means near its lower end for permitting said lower section to be selectively engaged and locked to said upper part; and a radius die releasably mounted on the upper end of said spindle assembly with said shoe bender, said die having means affixed thereto for releasably receiving and holding a pipe or tube.

2. The bender according to claim 1 wherein the upper end of said upper part of the spindle assembly is substantially square to cooperatively and slidably receive said radius die to hold it in a fixed position.

3. A pipe and tubing bender comprising:

a base member;

an upright spindle assembly having an upper part and a lower part having a vertical axis. said lower part being attached to said base member, said upper part being slidably and concentrically positioned around and over said lower part, said upper part being rotatable around the vertical axis of said lower part and having means for releasably securing said upper part to said lower part, said upper part having a flange near the bottom thereof, said flange having a plurality of notches around its periphery;

a lower section member having an inner end and an outer end, said inner end being slidably mounted on said upper part of the spindle assembly for rotational movement therearound, said lower section member having means for selectively and releasably engaging any notch in said flange to hold the lower section member in a fixed position;

an upper section member having an inner end and an outer end, said inner end being slidably mounted on said upper part for rotational movement therearound, the outer end of said upper section member being releasably and pivotally connected to the outer end of said lower section member, said upper section member having a bending shoe releasably mounted thereon and means for engaging and bending a pipe or tube; and a radius die member releasably fixed on the upper part of the spindle assembly and in pipe or tube engaging alignment with said bending shoe of the upper section member, said die member having pipe or tube holding means releasably attached thereto.

* * * * *